US011276285B2

(12) United States Patent
Lisewski

(10) Patent No.: US 11,276,285 B2
(45) Date of Patent: Mar. 15, 2022

(54) ARTIFICIAL INTELLIGENCE BASED MOTION DETECTION

(71) Applicant: Carrier Corporation, Palm Beach Gardens, FL (US)

(72) Inventor: Tomasz Lisewski, Gdansk (PL)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/734,471

(22) PCT Filed: Oct. 22, 2019

(86) PCT No.: PCT/US2019/057340

§ 371 (c)(1),
(2) Date: Dec. 2, 2020

(87) PCT Pub. No.: WO2020/086520

PCT Pub. Date: Apr. 30, 2020

(65) Prior Publication Data

US 2021/0272429 A1 Sep. 2, 2021

Related U.S. Application Data

(60) Provisional application No. 62/750,449, filed on Oct. 25, 2018.

(51) Int. Cl.

| | |
|---|---|
| ***G08B 13/19*** | (2006.01) |
| ***G08B 13/196*** | (2006.01) |
| ***G08B 29/18*** | (2006.01) |

(52) U.S. Cl.

CPC ..... *G08B 13/19* (2013.01); *G08B 13/1961* (2013.01); *G08B 29/186* (2013.01)

(58) Field of Classification Search

CPC G08B 13/19608; G08B 25/009; G08B 29/00; G06N 5/025; G06N 20/00

See application file for complete search history.

(56) References Cited

U.S. PATENT DOCUMENTS

| | | | |
|---|---|---|---|
| 7,924,212 | B2 | 4/2011 | Benitez et al. |
| 8,000,500 | B2 | 8/2011 | Park et al. |
| 9,000,918 | B1 | 4/2015 | Mclaughlin et al. |
| 9,107,586 | B2 | 8/2015 | Tran |

(Continued)

FOREIGN PATENT DOCUMENTS

| | | | |
|---|---|---|---|
| CN | 102346950 | A | 2/2012 |
| CN | 103785157 | A | 5/2014 |
| CN | 203931100 | U | 11/2014 |

OTHER PUBLICATIONS

International Preliminary Report on Patentability; dated Apr. 27, 2021; Application No. PCT/US2019/057340; Filed: Oct. 22, 2019; 6 pages.

(Continued)

*Primary Examiner* — Mirza F Alam
(74) *Attorney, Agent, or Firm* — Cantor Colburn LLP

(57) ABSTRACT

Methods and systems for motion detection are provided. Aspects includes receiving, from a sensor, sensor data associated with an area proximate to the sensor, determining an event type based on a feature vector, utilizing a machine learning model, the feature vector comprising a plurality of features extracted from the sensor data, and generating an alert based on the event type.

16 Claims, 3 Drawing Sheets

(56) References Cited

U.S. PATENT DOCUMENTS

| | | | | |
|---|---|---|---|---|
| 9,304,044 | B2 | 4/2016 | Micko | |
| 9,582,080 | B1 | 2/2017 | Tilton et al. | |
| 9,871,692 | B1 * | 1/2018 | Hutz | H04L 41/0686 |
| 2004/0136448 | A1 * | 7/2004 | Miller | H04L 69/40 375/222 |
| 2011/0228976 | A1 | 9/2011 | Fitzgibbon et al. | |
| 2013/0082842 | A1 | 4/2013 | Balazs et al. | |
| 2015/0164377 | A1 | 6/2015 | Nathan et al. | |
| 2016/0161339 | A1 | 6/2016 | Tan | |
| 2017/0364817 | A1 | 12/2017 | Raykov et al. | |
| 2018/0231419 | A1 | 8/2018 | Modi et al. | |
| 2018/0301022 | A1 * | 10/2018 | Boyd | G01J 1/4204 |
| 2019/0349213 | A1 * | 11/2019 | Shive | G06N 5/025 |
| 2021/0174095 | A1 * | 6/2021 | Kong | G06K 9/00335 |

OTHER PUBLICATIONS

International Search Report and Written Opinion; dated Jan. 16, 2020; Application No. PCT/US19/057340; Filed Oct. 22, 2019; 12 pages.

K. K. Eren and K. Küçük, "Machine learning based real-time activity detection system design," 2017 International Conference on Computer Science and Engineering (UBMK), Antalya, 2017, pp. 462-467.

* cited by examiner

200

ARTIFICIAL INTELLIGENCE BASED MOTION DETECTION

BACKGROUND

The subject matter disclosed herein generally relates to motion detection systems and, more particularly, to a neural network based motion detection system.

Motion detection devices typically utilize passive infrared, radar and/or ultrasound technology. The present disclosure relates to infrared technology. The passive infrared motion detectors utilize conversion of infrared radiation into an electrical signal. The infrared radiation is emitted by human bodies and the received signals by a detector are then analyzed in order to indicate motion of the body. This phenomenon and analysis are widely utilized in alarm systems. However, these systems are susceptible to false alarms that can be generated by heat sources other than a human or environmental disturbances.

BRIEF DESCRIPTION

According to one embodiment, a system is provided. The system includes a sensor, a controller coupled to a memory, the controller configured to receive, from the sensor, sensor data associated with an area proximate to the sensor, determine an event type based on a feature vector, utilizing a machine learning model, the feature vector comprising a plurality of features extracted from the sensor data, and generate an alert based on the event type.

In addition to one or more of the features described above, or as an alternative, further embodiments of the system may include that the event type comprises a true alarm event and a false alarm event.

In addition to one or more of the features described above, or as an alternative, further embodiments of the system may include that the true alarm event comprises a signal generated by a human movement in the area proximate to the sensor.

In addition to one or more of the features described above, or as an alternative, further embodiments of the system may include that the false alarm event comprises a signal generated by sources other than a human movement.

In addition to one or more of the features described above, or as an alternative, further embodiments of the system may include that the machine learning model is tuned with labeled training data and the labeled training data comprises historical motion event data.

In addition to one or more of the features described above, or as an alternative, further embodiments of the system may include that the plurality of features comprise characteristics of the signal generated by the sensor.

In addition to one or more of the features described above, or as an alternative, further embodiments of the system may include that the characteristics of the signal comprise at least one of a vector rotation, a maximum, a minimum, an average, a magnitude deviation from an average, a number of empty cells in a vector data table, a ratio of amplitudes, a ratio of signals integrals, a number of signal samples and a shape factor.

In addition to one or more of the features described above, or as an alternative, further embodiments of the system may include that the sensor comprises an infrared sensor.

In addition to one or more of the features described above, or as an alternative, further embodiments of the system may include that the sensor comprises a passive infrared sensor.

In addition to one or more of the features described above, or as an alternative, further embodiments of the system may include that generating the alert based on the event type includes setting an output to an alarm based on a classification by the machine learning model as the true alarm event.

According to one embodiment, a method is provided. The method includes receiving, from a sensor, sensor data associated with an area proximate to the sensor, determining an event type based on a feature vector, utilizing a machine learning model, the feature vector comprising a plurality of features extracted from the sensor data, and generating an alert based on the event type.

In addition to one or more of the features described above, or as an alternative, further embodiments of the method may include that the event type comprises a true alarm event and a false alarm event.

In addition to one or more of the features described above, or as an alternative, further embodiments of the method may include that the true alarm event comprises a signal generated by a human movement in the area proximate to the sensor.

In addition to one or more of the features described above, or as an alternative, further embodiments of the method may include that the false alarm event comprises a signal generated by sources other than a human movement.

In addition to one or more of the features described above, or as an alternative, further embodiments of the method may include that the machine learning model is tuned with labeled training data.

In addition to one or more of the features described above, or as an alternative, further embodiments of the method may include that the labeled training data comprises historical motion event data.

In addition to one or more of the features described above, or as an alternative, further embodiments of the method may include that the sensor data comprises a signal generated by the sensor.

In addition to one or more of the features described above, or as an alternative, further embodiments of the method may include that the plurality of features comprise characteristics of the signal generated by the sensor.

In addition to one or more of the features described above, or as an alternative, further embodiments of the method may include that the characteristics of the signal comprise at least one of a vector rotation, a maximum, a minimum, an average, a magnitude deviation from an average, a number of empty cells in a vector data table, a ratio of amplitudes, a ratio of signals integrals, a number of signal samples and a shape factor.

In addition to one or more of the features described above, or as an alternative, further embodiments of the method may include that the sensor comprises an infrared sensor.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
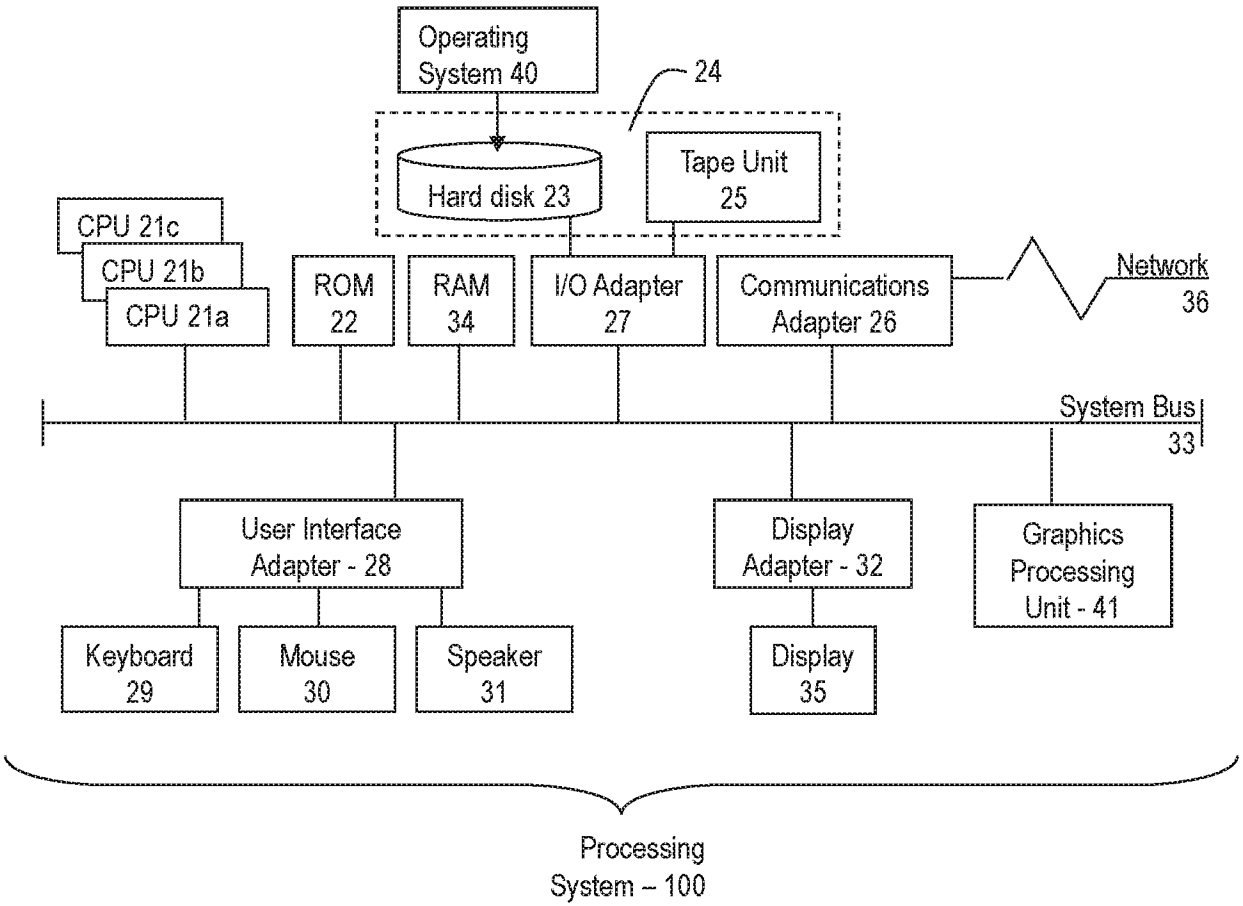
FIG. 1 depicts a block diagram of a computer system for use in implementing one or more embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Referring to FIG. 1, there is shown an embodiment of a processing system 100 for implementing the teachings herein. In this embodiment, the system 100 has one or more central processing units (processors) 21*a*, 21*b*, 21*c*, etc. (collectively or generically referred to as processor(s) 21). In one or more embodiments, each processor 21 may include a reduced instruction set computer (RISC) microprocessor. Processors 21 are coupled to system memory 34 (RAM) and various other components via a system bus 33. Read only memory (ROM) 22 is coupled to the system bus 33 and may include a basic input/output system (BIOS), which controls certain basic functions of system 100.

FIG. 1 further depicts an input/output (I/O) adapter 27 and a network adapter 26 coupled to the system bus 33. I/O adapter 27 may be a small computer system interface (SCSI) adapter that communicates with a hard disk 23 and/or tape storage drive 25 or any other similar component. I/O adapter 27, hard disk 23, and tape storage device 25 are collectively referred to herein as mass storage 24. Operating system 40 for execution on the processing system 100 may be stored in mass storage 24. A network communications adapter 26 interconnects bus 33 with an outside network 36 enabling data processing system 100 to communicate with other such systems. A screen (e.g., a display monitor) 35 is connected to system bus 33 by display adaptor 32, which may include a graphics adapter to improve the performance of graphics intensive applications and a video controller. In one embodiment, adapters 27, 26, and 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 all interconnected to bus 33 via user interface adapter 28, which may include, for example, a Super I/O chip integrating multiple device adapters into a single integrated circuit.

In exemplary embodiments, the processing system 100 includes a graphics processing unit 41. Graphics processing unit 41 is a specialized electronic circuit designed to manipulate and alter memory to accelerate the creation of images in a frame buffer intended for output to a display. In general, graphics processing unit 41 is very efficient at manipulating computer graphics and image processing and has a highly parallel structure that makes it more effective than general-purpose CPUs for algorithms where processing of large blocks of data is done in parallel. The processing system 100 described herein is merely exemplary and not intended to limit the application, uses, and/or technical scope of the present disclosure, which can be embodied in various forms known in the art.

Thus, as configured in FIG. 1, the system 100 includes processing capability in the form of processors 21, storage capability including system memory 34 and mass storage 24, input means such as keyboard 29 and mouse 30, and output capability including speaker 31 and display 35. In one embodiment, a portion of system memory 34 and mass storage 24 collectively store an operating system coordinate the functions of the various components shown in FIG. 1. FIG. 1 is merely a non-limiting example presented for illustrative and explanatory purposes.

Turning now to an overview of technologies that are more specifically relevant to aspects of the disclosure, as mentioned above, motion detection devices typically utilizes passive infrared sensor technology. The passive infrared motion detectors utilize conversion of infrared radiation into an electrical signal. A human body emits infrared radiation that generates a signal which can indicate motion of the body. This phenomenon is utilized in alarm systems. However, these systems are susceptible to false alarms that can be generated by other heat sources or environmental disturbances. A need exists to distinguish a true alarm from a false alarm using parameters of the output electrical signal from an infrared element.

Turning now to an overview of the aspects of the disclosure, one or more embodiments address the above-described shortcomings of the prior art by providing a motion detection system that utilizes learning analytics on electrical signals to distinguish between true alarms and false alarms. The motion detection system can detect several types of events associated with the movement of a person at or near the motion detector. These types of events (true alarm events) that can trigger an alarm can include, but are not limited to, slow and fast walking, running, crawling, and intermittent walking. There are types of events that should not trigger an alarm. For example, hot air flow, mechanical shocks, electromagnetic disturbances, temperature changes of heating devices, or white light should not be considered a true alarm event. The motion detection system can utilize a sensor to generate an electrical signal for each type of event based on sensor readings. The electrical signal includes different values that can be analyzed to distinguish one type of event over another type of event. For example, a person walking near the sensor would generate a different signal pattern than the influx of hot air into an area near the sensor. The motion detection system utilizes a machine learning model to analyze the different parameters of the electrical signal generated from the sensor to determine an event type and thus identify if the event warrants an alert or alarm (e.g., true alarm event).

Figure 2:
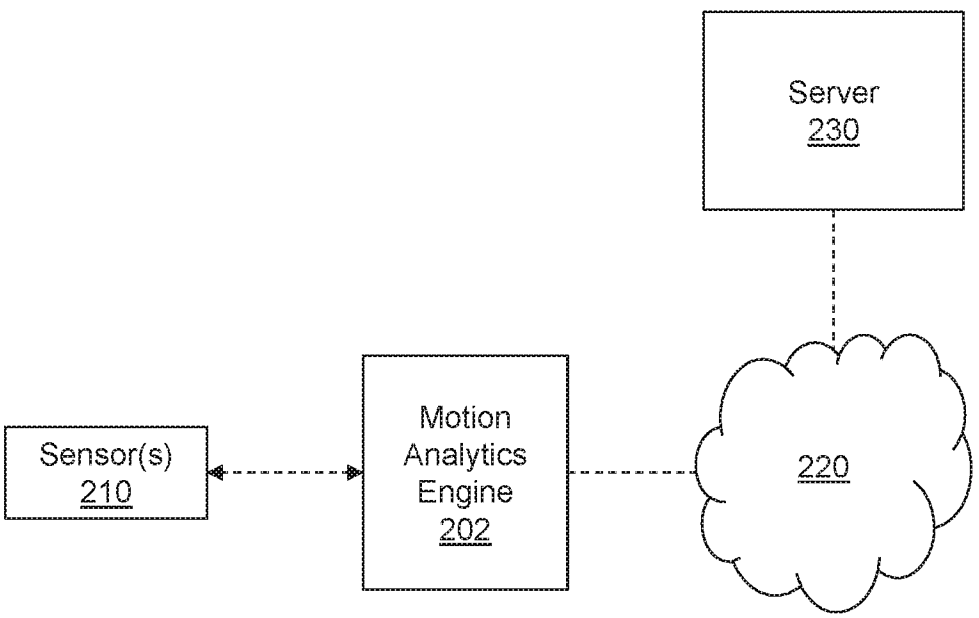
FIG. 2 depicts a block diagram of a system for motion detection according to one or more embodiments of the disclosure.

Turning now to a more detailed description of aspects of the present disclosure, FIG. 2 depicts a system 200 for motion detection according to one or more embodiments. The system 200 includes one or more sensors 210 in communication with a motion analytics engine 202. In one or more embodiments, the motion analytics engine 202 can be local to the sensor or can be in electronic communication with the sensors 210 through a network 220 and stored on a server 230 of the system 200. In one or more embodiments, the sensor 210 is configured to collect sensor data associated with an area proximate to the sensor 210. The sensor 210 can be an infrared sensor, a passive infrared sensor, or the like.

The sensor data collected from the sensor 210 can be analyzed by the motion analytics engine 202 to determine an event, such as the presence of a person moving through the area proximate to the sensors 210. The motion analytics engine 202 can distinguish between different possible types of events to determine if an event is a true alarm event or a false alarm event. The motion analytics engine 202 can utilize one or more machine learning models to analyze the electrical signal or pattern generated from the sensor data. The different parameters or characteristics of the electrical signal can be extracted from the sensor data and utilized as features in a feature vector. This feature vector can be analyzed to identify the type of event and whether the event qualifies as a true alarm event or a false alarm event.

In embodiments, the engine 202 (motion analytics engine) can also be implemented as so-called classifiers (described in more detail below). In one or more embodiments, the features of the various engines/classifiers (202) described herein can be implemented on the processing system 100 shown in FIG. 1, or can be implemented on a neural network (not shown). In embodiments, the features of the engines/classifiers 202 can be implemented by configuring and arranging the processing system 100 to execute machine learning (ML) algorithms. In general, ML algorithms, in effect, extract features from received data (e.g., inputs to the engines 202) in order to "classify" the received data. Examples of suitable classifiers include but are not limited to neural networks (described in greater detail below), support vector machines (SVMs), logistic regression, decision trees, hidden Markov Models (HMMs), etc. The end result of the classifier's operations, i.e., the "classification," is to predict a class for the data. The ML algorithms apply machine learning techniques to the received data in order to, over time, create/train/update a unique "model." The learning or training performed by the engines/classifiers 202 can be supervised, unsupervised, or a hybrid that includes aspects of supervised and unsupervised learning. Supervised learning is when training data is already available and classified/labeled. Unsupervised learning is when training data is not classified/labeled so must be developed through iterations of the classifier. Unsupervised learning can utilize additional learning/training methods including, for example, clustering, anomaly detection, neural networks, deep learning, and the like.

In embodiments, where the engines/classifiers 202 are implemented as neural networks, a resistive switching device (RSD) can be used as a connection (synapse) between a pre-neuron and a post-neuron, thus representing the connection weight in the form of device resistance. Neuromorphic systems are interconnected processor elements that act as simulated "neurons" and exchange "messages" between each other in the form of electronic signals. Similar to the so-called "plasticity" of synaptic neurotransmitter connections that carry messages between biological neurons, the connections in neuromorphic systems such as neural networks carry electronic messages between simulated neurons, which are provided with numeric weights that correspond to the strength or weakness of a given connection. The weights can be adjusted and tuned based on experience, making neuromorphic systems adaptive to inputs and capable of learning. For example, a neuromorphic/neural network for handwriting recognition is defined by a set of input neurons, which can be activated by the pixels of an input image. After being weighted and transformed by a function determined by the networks designer, the activations of these input neurons are then passed to other downstream neurons, which are often referred to as "hidden" neurons. This process is repeated until an output neuron is activated. Thus, the activated output neuron determines (or "learns") which character was read. Multiple pre-neurons and post-neurons can be connected through an array of RSD, which naturally expresses a fully-connected neural network. In the descriptions here, any functionality ascribed to the system 200 can be implemented using the processing system 100 applies.

In one or more embodiments, motion analytics engine 202 can be trained/tuned utilizing labelled training data. The labelled training data can include electrical signals indicative of known types of events such as, for example, a person walking or the influx of hot air. The parameters of the electrical signals are extracted as features into a feature vector that can be analyzed by the motion analytics engine 202. In one or more embodiments, the motion analytics engine 202 can be trained on the server 230 or other processing system and then implemented as a decision making machine learning model for the motion sensor system 200.

In one or more embodiments, the motion analytics engine 202 can identify an event type by utilizing a plurality of features extracted from the sensor data. The sensor data can be collected from a dual channel infrared sensor. Each channel value in the time domain (CH1(t) and CH2(t)) can be associated with one of orthogonal coordinates (X-axis, Y-axis). Therefore, the signal can be represented by a vector V=[X; Y]. The vector typically rotates when the sensor is excited by a human motion and plots a fraction of a circle. During the event the vector has its rotation angle, maximum, minimum, average, deviation from average, ratio between maximum and average, ratio between minimum and average, ratio between deviation and average and shape factor related to an encircled area size. The other features not related to the vector can be used, such as: a ratio between maximum of channel 1 and maximum of channel 2, a ratio of integrals of signals from the channels, a maximum of signals derivative and a time relation of channels extrema occurrence. The sensor data can be limited by the event borders that can be defined with an event start condition and an event end condition. The event start condition can work as a pre-classifier which does not allow taking into account signals that are too low or do not rotate. The event start condition can include the signal parameter being above a noise value (e.g., an amplitude threshold) or an angle threshold (e.g., when a vector rotation occurs). The event end condition can include the signal parameter being at the level of a noise value, no rotation being observed or the signal being long enough to correctly classify the event. The signal can be divided into parts and the best part can be selected for analysis.

In one or more embodiments, the one or more sensors 210 can include radar detectors, ultrasound detectors, glass break detectors, and/or shock sensors. The signals generated from the these sensors can utilize the same approach described for the motion sensor techniques herein.

Figure 3:
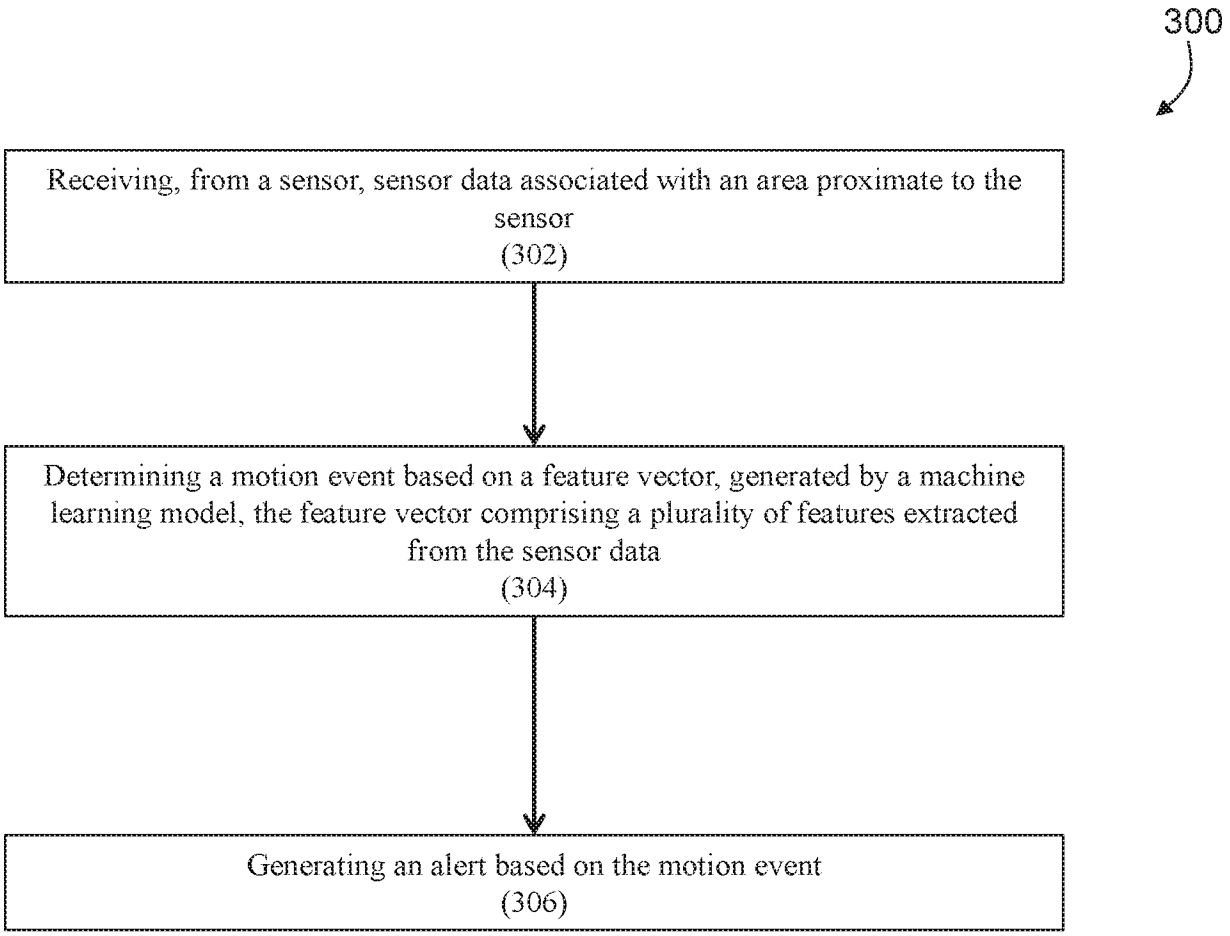
FIG. 3 depicts a flow diagram of a method for motion detection according to one or more embodiments of the disclosure.

FIG. 3 depicts a flow diagram of a method for motion detection according to one or more embodiments. The method 300 includes receiving, from a sensor, sensor data associated with an area proximate to the sensor, as shown at block 302. The method 300, at block 304, includes determining a motion event type based on a feature vector, generated by a machine learning model, the feature vector comprising a plurality of features extracted from the sensor data. And at block 306, the method 300 includes generating an alert based on the motion event type.

Additional processes may also be included. It should be understood that the processes depicted in FIG. 3 represent illustrations and that other processes may be added or existing processes may be removed, modified, or rearranged without departing from the scope and spirit of the present disclosure.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system for motion detection, the system comprising:
a sensor;
a controller coupled to a memory, the controller configured to:
receive, from the sensor, sensor data associated with an area proximate to the sensor;
utilize a machine learning model to determine an event type based on a feature vector, the feature vector comprising a plurality of features extracted from the sensor data; and
generate an alert based on the event type;
wherein the sensor comprises an infrared sensor;
wherein the event type comprises a true alarm event and a false alarm event.

2. The system of claim 1, wherein the true alarm event comprises a signal generated by a human movement in the area proximate to the sensor.

3. The system of claim 1, wherein the false alarm event comprises a signal generated by sources other than a human movement.

4. The system of claim 1, wherein the machine learning model is tuned with labeled training data; and
wherein the labeled training data comprises historical motion event data.

5. The system of claim 1, wherein the plurality of features comprise characteristics of the signal generated by the sensor.

6. The system of claim 5, wherein the characteristics of the signal comprise at least one of a vector rotation, a maximum, a minimum, an average, a magnitude deviation from an average, a number of empty cells in a vector data table, a ratio of amplitudes, a ratio of signals integrals, a number of signal samples and a shape factor.

7. The system of claim 1, wherein the sensor comprises a passive infrared sensor.

8. The system of claim 1, wherein generating the alert based on the event type comprises:
setting an output to an alarm based on a classification by the machine learning model as the true alarm event.

9. A method for motion detection, the method comprising:
receiving, from a sensor, sensor data associated with an area proximate to the sensor;
utilizing a machine learning model to determine an event type based on a feature vector, the feature vector comprising a plurality of features extracted from the sensor data; and
generating an alert based on the event type;
wherein the sensor comprises an infrared sensor;
wherein the event type comprises a true alarm event and a false alarm event.

10. The method of claim 9, wherein the true alarm event comprises a signal generated by a human movement in the area proximate to the sensor.

11. The method of claim 9, wherein the false alarm event comprises a signal generated by sources other than a human movement.

12. The method of claim 9, wherein the machine learning model is tuned with labeled training data.

13. The method of claim 12, wherein the labeled training data comprises historical motion event data.

14. The method of claim 9, wherein the sensor data comprises a signal generated by the sensor.

15. The method of claim 9, wherein the plurality of features comprise characteristics of the signal generated by the sensor.

16. The method of claim 15, wherein the characteristics of the signal comprise at least one of a vector rotation, a maximum, a minimum, an average, a magnitude deviation from an average, a number of empty cells in a vector data table, a ratio of amplitudes, a ratio of signals integrals, a number of signal samples and a shape factor.

* * * * *